US010968412B2

(12) United States Patent
Sherman et al.

(10) Patent No.: US 10,968,412 B2
(45) Date of Patent: Apr. 6, 2021

(54) LUBRICANT COMPOSITION

(71) Applicant: BASF SE, Ludwigshafen (DE)

(72) Inventors: John Sherman, Plymouth, MI (US); Patrice Cusatis, Newburgh, NY (US); Paul Leonard Fasano, Carmel, NY (US)

(73) Assignee: BASF SE, Ludwigshafen am Rhein (DE)

( * ) Notice: Subject to any disclaimer, the term of this patent is extended or adjusted under 35 U.S.C. 154(b) by 19 days.

(21) Appl. No.: 16/334,981

(22) PCT Filed: Sep. 21, 2017

(86) PCT No.: PCT/US2017/052705

§ 371 (c)(1),
(2) Date: Mar. 20, 2019

(87) PCT Pub. No.: WO2018/057730

PCT Pub. Date: Mar. 29, 2018

(65) Prior Publication Data

US 2020/0017792 A1 Jan. 16, 2020

Related U.S. Application Data

(60) Provisional application No. 62/398,725, filed on Sep. 23, 2016.

(51) Int. Cl.

| | |
|---|---|
| ***C10M 107/34*** | (2006.01) |
| ***C10M 169/04*** | (2006.01) |
| ***C10M 173/02*** | (2006.01) |
| ***C10N 20/02*** | (2006.01) |
| ***C10N 30/00*** | (2006.01) |

(52) U.S. Cl.

CPC ..... *C10M 107/34* (2013.01); *C10M 169/04* (2013.01); *C10M 173/02* (2013.01); *C10M 2209/1033* (2013.01); *C10M 2209/1045* (2013.01); *C10M 2209/1055* (2013.01); *C10M 2209/1075* (2013.01); *C10M 2209/1085* (2013.01); *C10N 2020/02* (2013.01); *C10N 2030/64* (2020.05)

(58) Field of Classification Search

CPC ..... C10M 107/34; C10M 169/04; C10M 169/041; C10M 173/02; C10M 2209/103; C10M 2209/1033; C10M 2209/104; C10M 2209/1045; C10M 2209/105; C10M 2209/1055; C10M 2209/107; C10M 2209/1075; C10M 2209/108; C10M 2209/1085

See application file for complete search history.

(56) References Cited

U.S. PATENT DOCUMENTS

| | | | | |
|---|---|---|---|---|
| 7,456,138 | B2 * | 11/2008 | Sherman | C10M 171/008 508/579 |
| 2004/0235679 | A1 | 11/2004 | Kurosky et al. | |
| 2005/0256014 | A1 | 11/2005 | Sherman et al. | |
| 2010/0197539 | A1 * | 8/2010 | Greaves | C10M 173/02 508/511 |
| 2010/0204075 | A1 | 8/2010 | da Costa | |
| 2018/0016518 | A1 * | 1/2018 | Kaneko | C10M 145/28 |

FOREIGN PATENT DOCUMENTS

| | | | | |
|---|---|---|---|---|
| DE | 265528 | A3 | 3/1989 | |
| WO | WO-2016117378 | A1 * | 7/2016 | C10M 145/32 |

OTHER PUBLICATIONS

Reigh C. Gunderson, "Synthetic Lubricants", Jan. 1, 1962, http://msdssearch.dow.com/PublishedLiteratureDOWCOM/dh_08b1/0901b803808b1f60.pdf?filepath=productsafety/pdfs/noreg/233-00900.pdf&fromPage=GetDoc.

International Search Report dated Apr. 12, 2017 for PCT/US2017/052705, 3 pages.

* cited by examiner

*Primary Examiner* — James C Goloboy
(74) *Attorney, Agent, or Firm* — Lowenstein Sandler LLP

(57) ABSTRACT

A lubricant composition includes a biodegradable polyalkylene glycol, an inherently-biodegradable polyalkylene glycol, and a non-biodegradable polyalkylene glycol. The biodegradable polyalkylene glycol satisfies the biodegradability requirements set forth in OECD 301B. The inherently-biodegradable polyalkylene glycol satisfy the inherently-biodegradability requirements set forth in OECD 301B. The non-biodegradable polyalkylene glycol is defined by OECD 301B and satisfies the non-bioaccumulative requirements set forth in OECD 107. The lubricant composition includes the biodegradable polyalkylene glycol in an amount of at least about 30 parts by weight, the inherently-biodegradable polyalkylene glycol in an amount of from about 0.1 to about 10 parts by weight, and the non-biodegradable polyalkylene glycol in an amount of from about 0.1 to about 5 parts by weight, each based on 100 parts by weight of the lubricant composition.

19 Claims, No Drawings

LUBRICANT COMPOSITION

CROSS-REFERENCE TO RELATED APPLICATION(S)

This application is a national phase of International Application No. PCT/US2017/052705, filed on Sep. 21, 2017, which claims the benefit of U.S. Provisional Patent Application No. 62/398,725, filed on Sep. 23, 2016. The contents of these applications are hereby incorporated by reference in their entirety.

FIELD OF THE DISCLOSURE

The present disclosure generally relates to a lubricant composition.

BACKGROUND OF THE DISCLOSURE

In the marine industry, conventional lubricants may be harmful to the environment if the conventional lubricant was to egress into the environment. Recently, market forces and governmental regulations have placed a renewed emphasis on improving the environmental profile (e.g. biodegradability and toxicity) of lubricant compositions that may eventually egress into the environment. As such, there is an opportunity to develop a lubricant composition that is environmentally friendly.

SUMMARY OF THE DISCLOSURE AND ADVANTAGES

The present disclosure provides a lubricant composition. The lubricant composition includes a biodegradable polyalkylene glycol, an inherently-biodegradable polyalkylene glycol, and a non-biodegradable polyalkylene glycol. The biodegradable polyalkylene glycol satisfies the biodegradability requirements set forth in the Organization for Economic Co-operation and Development (OECD) 301B. Likewise, the inherently-biodegradable polyalkylene glycol satisfy the inherently-biodegradability requirements set forth in OECD 301B. The non-biodegradable polyalkylene glycol is defined by OECD 301B and satisfies the non-bioaccumulative requirements set forth in OECD 107. The lubricant composition includes the biodegradable polyalkylene glycol in an amount of at least about 30 parts by weight, the inherently-biodegradable polyalkylene glycol in an amount of from about 0.1 to about 10 parts by weight, and the non-biodegradable polyalkylene glycol in an amount of from about 0.1 to about 5 parts by weight, each based on 100 parts by weight of the lubricant composition. The lubricant composition of this disclosure is effective as a lubricant and is also environmentally friendly.

DETAILED DESCRIPTION OF THE DISCLOSURE

The present disclosure provides a lubricant composition. The lubricant composition may be utilized in a variety of lubricating applications, and is especially useful as a lubricant for marine vessels.

The lubricant composition includes a first polyalkylene glycol. The first polyalkylene glycol is a biodegradable polyalkylene glycol. The biodegradable polyalkylene glycol is a polyalkylene glycol satisfying the biodegradability requirements set forth in OECD 301B. Those skilled in the art understand that a biodegradable designation (also referred to as "ready biodegradability") is the most stringent defined by OECD protocols. In particular, to be designated biodegradable, OECD 301B requires that 60 wt. % of the carbon in a test substance be mineralized to inorganic carbon within a 10-day window during a 28-day incubation, under rigidly-defined test conditions. It is to be appreciated that any reference to an OECD guideline in the context of this disclosure is referencing the OECD guidelines as adopted on Jul. 27, 1995.

The lubricant composition includes the biodegradable polyalkylene glycol in an amount of at least about 30 parts by weight based on 100 parts by weight of the lubricant composition. Typically, the biodegradable polyalkylene glycol is present in an amount of from about 30 to about 90 parts by weight based on 100 parts by weight of the lubricant composition. Alternatively, the biodegradable polyalkylene glycol is present in an amount of from about 30 to about 85, from about 30 to about 80, from about 30 to about 75, from about 30 to about 70, from about 30 to about 65, from about 30 to about 60, from about 30 to about 55, from about 30 to about 50, from about 30 to about 45, or from about 30 to about 40, parts by weight based on 100 parts by weight of the lubricant composition.

The lubricant composition also includes a second polyalkylene glycol. The second polyalkylene glycol is an inherently-biodegradable polyalkylene glycol. The inherently-biodegradable polyalkylene glycol is a polyalkylene glycol that satisfies the inherently-biodegradable requirements set forth in OECD 301B. Those skilled in the art understand that an inherently-biodegradable designation is a less stringent definition in comparison to a biodegradable designation. In particular, to be designated inherently-biodegradable, OECD 301B requires at least 20 wt. % of the carbon in a test substance be mineralized to inorganic carbon but does not require this mineralization within a specified time limit. Those skilled in the art will also understand that despite satisfying the inherently-biodegradability requirements set forth in OECD 301B, the inherently-biodegradable polyalkylene glycol does not satisfy the biodegradability requirements set forth in OECD 301B. Accordingly, the biodegradable polyalkylene glycol and the inherently-biodegradable polyalkylene glycol are different.

The inherently-biodegradable polyalkylene glycol is present in an amount of from about 0.1 to about 10 parts by weight based on 100 parts by weight of the lubricant composition. Alternatively, the inherently-biodegradable polyalkylene glycol is present in an amount of from about 1 to about 10, from about 3 to about 10, from about 5 to about 10, from about 7 to about 10, from about 1 to about 9, from about 3 to about 7, or about 5, parts by weight based on 100 parts by weight of the lubricant composition.

The lubricant composition further includes a third polyalkylene glycol. The third polyalkylene glycol is a non-biodegradable polyalkylene glycol as defined by OECD 301B. The non-biodegradable polyalkylene glycol is a polyalkylene glycol that does not satisfy the biodegradability and the inherently-biodegradability requirements set forth in OECD 301B. Accordingly, the biodegradable polyalkylene glycol, the inherently-biodegradable polyalkylene glycol, and the non-biodegradable polyalkylene glycol are different. In addition, the non-biodegradable polyalkylene glycol satisfies the non-bioaccumulative requirements set forth in OECD 107. Those skilled in the art appreciate that bioaccumulation refers to substances, (e.g. chemicals) that accumulate in an organism. Moreover, bioaccumulation occurs when an organism absorbs a substance at a rate faster than that at which the substance is lost by catabolism and excretion. Accordingly, the non-biodegradable polyalkylene glycol does not accumulate in organisms. The lack of accumulation determined by OECD 107 may be accomplished using a UV-Vis spectrophotometer and measuring the apparent partition coefficient.

The non-biodegradable polyalkylene glycol is present in an amount of from about 0.1 to about 5 parts by weight based on 100 parts by weight of the lubricant composition. Alternatively, the non-biodegradable biodegradable polyalkylene glycol is present in an amount of from about 0.1 to about 4, from about 0.1 to about 3, from about 0.1 to about 2, from about 0.1 to about 1, from about 1 to about 5, from about 3 to about 5, or about 5, parts by weight based on 100 parts by weight of the lubricant composition.

Referring back to the biodegradable polyalkylene glycol, although not required, the biodegradable polyalkylene glycol typically has a kinematic viscosity at 40° C. of from about 30 to about 120 cSt, when measured in accordance with ASTM D445. Alternatively, the biodegradable polyalkylene glycol typically has a kinematic viscosity at 40° C. of from about 40 to about 120, from about 50 to about 120, from about 60 to about 120, from about 70 to about 120, from about 80 to about 120, from about 90 to about 120, from about 100 to about 120, from about 40 to about 100, from about 40 to about 80, from about 40 to about 60, from about 50 to about 110, from about 60 to about 100, or from about 70 to about 90, cSt when measured in accordance with ASTM D445. It is to be appreciated that any reference to kinematic viscosity within this disclosure is the kinematic viscosity measured in accordance with ASTM D445 at 40° C.

The biodegradable polyalkylene glycol may comprise one or more polyalkylene glycols provided that each polyalkylene glycol satisfies the criterion for biodegradability as set forth in OECD 301B. In certain embodiments, the biodegradable polyalkylene glycol comprises a copolymer of ethylene oxide and propylene oxide. The copolymer of ethylene oxide and propylene oxide of the biodegradable polyalkylene glycol may have a mole ratio of ethylene oxide to propylene oxide of from about 40:60 to about 60:40. Moreover, the copolymer of ethylene oxide and propylene oxide is typically initiated with mono functional initiator such as butanol. Alternatively, the copolymer of ethylene oxide and propylene oxide may be initiated by a difunctional initiator such as ethylene glycol, propylene glycol, or a combination thereof. In certain embodiments the biodegradable polyalkylene glycol is water soluble.

In one embodiment, the biodegradable polyalkylene glycol is a butanol initiated copolymer of ethylene oxide and propylene oxide having an ethylene oxide to propylene oxide mole ratio of from about 40:60 to about 60:40. Although not required, the biodegradable polyalkylene glycol of this embodiment typically has a kinematic viscosity at 40° C. of from about 30 to about 120 cSt, when measured in accordance with ASTM D445.

Referring back to the inherently-biodegradable polyalkylene glycol, although not required, the inherently-biodegradable polyalkylene glycol typically has a kinematic viscosity at 40° C. of from about 130 to about 5,000, cSt when measured in accordance with ASTM D445. Alternatively, the inherently-biodegradable polyalkylene glycol typically has a kinematic viscosity at 40° C. of from about 200 to about 5,000, from about 600 to about 5,000, from about 1,000 to about 5,000, from about 1,400 to about 5,000, from about 2,000 to about 5,000, from about 2,400 to about 5,000, from about 2,800 to about 5,000, from about 3,200 to about 5,000, from about 3,600 to about 5,000, from about 4,000 to about 5,000, from about 200 to about 4,600, from about 600 to about 4,200, from about 1,000 to about 3,800, from about 1,400 to about 3,400, from about 1,800 to about 3,000, or from about 2,200 to about 2,600, cSt when measured in accordance with ASTM D445

The inherently-biodegradable polyalkylene glycol may comprise one or more polyalkylene glycols provided that each polyalkylene glycol satisfies the criterion for inherent biodegradability set forth in OECD 301B. In certain embodiments, the polyalkylene glycol of the inherently-biodegradable polyalkylene glycol is a copolymer of ethylene oxide and propylene oxide initiated with a glycol. In certain embodiments the initiating glycol is diethylene glycol, dipropylene glycol, or a combination thereof. Alternatively, the copolymer of ethylene oxide and propylene oxide may be initiated with a monofunctional initiator such as butanol. The copolymer of ethylene oxide and propylene oxide of the inherently-biodegradable polyalkylene glycol may have a mole ratio of ethylene oxide to propylene oxide of from about 65:35 to about 85:15.

In one embodiment, the inherently-biodegradable polyalkylene glycol is a glycol initiated copolymer of ethylene oxide and propylene oxide having an ethylene oxide to propylene oxide mole ratio of from about 65:35 to about 85:15. Although not required, the inherently-biodegradable polyalkylene glycol of this embodiment typically has a kinematic viscosity at 40° C. of from about 130 to about 5,000, cSt, when measured in accordance with ASTM D445.

In certain embodiments, the lubricant composition comprises (1) the biodegradable polyalkylene glycol comprising a butanol initiated copolymer of ethylene oxide and propylene oxide having an ethylene oxide to propylene oxide mole ratio of from about 40:60 to about 60:40, and a kinematic viscosity at 40° C. of from about 30 to about 120 cSt, when measured in accordance with ASTM D445, and (2) the biodegradable polyalkylene glycol comprising a glycol initiated copolymer of ethylene oxide and propylene oxide having an ethylene oxide to propylene oxide mole ratio of from about 65:35 to about 85:15 and a kinematic viscosity at 40° C. of from about 130 to about 5,000, cSt, when measured in accordance with ASTM D445.

Referring back to the non-biodegradable polyalkylene glycol, although not required, the non-biodegradable polyalkylene glycol typically has a kinematic viscosity at 40° C. of greater than about 15,000 when measured in accordance with ASTM D445. Alternatively, the non-biodegradable polyalkylene glycol typically has a kinematic viscosity at 40° C. of from about 15,000 to about 100,000, from about 20,000 to about 100,000, from about 30,000 to about 100,000, from about 40,000 to about 100,000, from about 50,000 to about 100,000, from about 60,000 to about 100,000, from about 70,000 to about 100,000, from about 80,000 to about 100,000, from about 20,000 to about 90,000, from about 20,000 to about 80,000, from about 20,000 to about 70,000, from about 20,000 to about 60,000, from about 20,000 to about 50,000, from about 20,000 to about 40,000, from about 30,000 to about 90,000, from about 40,000 to about 80,000, from about 50,000 to about 70,000, or about 60,000, cSt when measured in accordance with ASTM D445.

The non-biodegradable polyalkylene glycol may comprise one or more polyalkylene glycols provided that each polyalkylene glycol is deemed non-biodegradable as set forth in OECD 301B and also satisfies the non-bioaccumulative requirements set forth in OECD 107. Typically, the non-biodegradable polyalkylene glycol is present in an amount of from about 0.1 to about 5 parts by weight based on 100 parts by weight of the lubricant composition. In certain embodiments, the non-biodegradable polyalkylene glycol comprises a copolymer of ethylene oxide and propylene oxide. The copolymer of ethylene oxide and propylene oxide of the non-biodegradable polyalkylene glycol may have a mole ratio of ethylene oxide to propylene oxide of from about 65:35 to about 85:15. Moreover, the copolymer of ethylene oxide and propylene oxide is typically initiated with a trifunctional initiator such as trimethylolpropane.

In one embodiment, the non-biodegradable polyalkylene glycol is a trimethylolpropane initiated copolymer of ethylene oxide and propylene oxide having an ethylene oxide to propylene oxide mole ratio of from about 65:35 to about 85:15. Although not required, the biodegradable polyalkylene glycol of this embodiment typically has a kinematic viscosity at 40° C. of from about 15,000 to about 100,000, cSt when measured in accordance with ASTM D445.

In certain embodiments, the lubricant composition comprises (1) the biodegradable polyalkylene glycol comprising a butanol initiated copolymer of ethylene oxide and propylene oxide having an ethylene oxide to propylene oxide mole ratio of from about 40:60 to about 60:40, and a kinematic viscosity at 40° C. of from about 30 to about 120 cSt, when measured in accordance with ASTM D445, (2) the biodegradable polyalkylene glycol comprising a glycol initiated copolymer of ethylene oxide and propylene oxide having an ethylene oxide to propylene oxide mole ratio of from about 65:35 to about 85:15 and a kinematic viscosity at 40° C. of from about 130 to about 5,000, cSt, when measured in accordance with ASTM D445, and (3) the non-biodegradable polyalkylene glycol comprising a trimethylolpropane initiated copolymer of ethylene oxide and propylene oxide having an ethylene oxide to propylene oxide mole ratio of from about 65:35 to about 85:15 and a kinematic viscosity at 40° C. of from about 15,000 to about 100,000, cSt when measured in accordance with ASTM D445.

In certain embodiments, the lubricant composition further comprises a low viscosity component. The low viscosity component has a kinematic viscosity at 40° C. that is less than the kinematic viscosity of the biodegradable polyalkylene glycol. In other words, the low viscosity component has a kinematic viscosity at 40° C. less than about 30 cSt, when measured in accordance with ASTM D445. In certain embodiments, the low viscosity component has a kinematic viscosity at 40° C. of from about 0.5 to about 30 cSt when measured in accordance with ASTM D445. Alternatively, the low viscosity component has a kinematic viscosity at 40° C. of from about 0.5 to about 25, from about 0.5 to about 20, from about 0.5 to about 15, from about 0.5 to about 10, from about 2 to about 10, or from about 4 to about 10, cSt when measured in accordance with ASTM D445.

In certain embodiments, the low viscosity component is chosen from the group of ethylene glycol, diethylene glycol, propylene glycol, water, or a combination thereof. If included, the low viscosity component is present in an amount of from about 25 to about 60 parts by weight based on 100 parts by weight of the lubricant composition. Alternatively, the low viscosity component is present in an amount of from about 30 to about 60, from about 30 to about 55, from about 30 to about 50, from about 30 to about 45, from about 30 to about 40, from about 35 to about 60, from about 40 to about 60, from about 45 to about 60, or from about 50 to about 60, parts by weight based on 100 parts by weight of the lubricant composition.

In certain embodiments, the lubricant composition comprises the biodegradable polyalkylene glycol, the inherently-biodegradable polyalkylene glycol, the non-biodegradable polyalkylene glycol, and the low viscosity component in a combined amount of from about 85 to about 100 parts by weight based on 100 parts by weight of the lubricant composition.

In certain embodiments, the lubricant composition is essentially free of Type I, II, III, and IV base oils, as classified according to the American Petroleum Institute (API) Base Oil Interchangeability Guidelines. In the context of this disclosure, "essentially free of Type I, II, III, and IV base oils" means that the lubricant composition includes less than a combined amount of about 5 parts by weight of Type I, II, III, and IV base oils, based on 100 parts by weight of the lubricant composition. Alternatively, "essentially free of Type I, II, III, and IV base oils" means that the lubricant composition includes less than a combined amount of about 4, about 3, about 2, or about 1, parts by weight of Type I, II, III, and IV base oils, based on 100 parts by weight of the lubricant composition. As one example, the lubricant composition may still be essentially free of Type I, II, III, and IV base oils and contain about 4 parts by weight of one or more of these oils when one of the additives (described further below) included in the lubricant composition is dispersed in a Type I, II, III, and/or IV base oil.

In certain embodiments, the lubricant composition has a kinematic viscosity at 40° C. of from about 25 to about 70 cSt when measured in accordance with ASTM D445. In certain embodiments, the lubricant composition has a kinematic viscosity at 40° C. of from about 30 to about 60, from about 35 to about 55, or from about 40 to about 50, cSt when measured in accordance with ASTM D445.

The lubricant composition may further comprise an additive package. The additive package includes at least one additive effective to improve at least one property of the lubricant composition and/or the performance of the equipment in which the lubricant composition is to be used. In certain embodiments, the additive package includes at least one additive chosen from antioxidants, metal deactivators, dispersants, corrosion inhibitors, foam control additives, extreme pressure additives, anti-wear additives, detergents, and dyes.

It is to be appreciated that the individual additives included in the additive package may be combined with one or more other additives prior to being added to the lubricant composition, or in the alternative, the individual additives may be separately added to the lubricant composition. In other words, the additive package does not require that all, or even a portion, of the additives be combined prior to being combined with the biodegradable polyalkylene glycol, the inherently-biodegradable polyalkylene glycol, or the non-biodegradable polyalkylene glycol.

When the lubricant composition includes the additive package, the additive package is typically present in an amount of from about 1 to about 15, from about 3 to about 14, from about 5 to about 13, from about 6 to about 12, or from about 7 to about 11, parts by weight based on 100 parts by weight of the lubricant composition.

In regards to the anti-wear additive, any anti-wear additive known in the art may be included. Suitable, non-limiting examples of the anti-wear additive include salts of dimethylethanolamine and capric acid, zinc dialkyl-dithio phosphate ("ZDDP"), zinc dialkyl-dithio phosphates, sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl) phosphorothioate and mixtures thereof (for example tris(isononylphenyl) phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris [isooctyl 2-acetate], derivatives of 2-mercaptobenzothiazole such as 1-[N,N-bis (2-ethylhexyl)aminomethyl]-2-mercapto-1H-1,3-benzothiazole, ethoxycarbonyl-5-octyldithio carbamate, ashless anti-wear additives including phosphorous, and/or combinations thereof. In one embodiment, the anti-wear additive is ZDDP.

If included, the anti-wear additive may be present in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, parts by weight based on 100 parts by weight of the lubricant composition. The amount of anti-wear additive may vary outside of the ranges above, but is typically both whole and fractional values within these ranges. Further, it is to be appreciated that more than one anti-wear additive may be included in the lubricant composition, in which case the total amount of all the anti-wear additive included is within the above ranges.

In regards to the extreme pressure agent, any extreme pressure agent known in the art may be used. Suitable non-limiting examples of the extreme pressure agent include compounds containing boron and/or sulphur and/or phosphorus.

In one embodiment, the extreme pressure agent is a sulphur-containing compound. In one embodiment, the sulphur-containing compound may be a sulphurised olefin, a polysulphide, or mixtures thereof. Examples of the sulphurised olefin include a sulphurised olefin derived from propylene, isobutylene, pentene; an organic sulphide and/or polysulphide including benzyldi-sulphide; bis-(chlorobenzyl) disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment, the sulphurised olefin includes a sulphurised olefin derived from propylene, isobutylene, pentene or mixtures thereof.

If included, the extreme pressure agent may present in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, parts by weight based on 100 parts by weight of the lubricant composition. The amount of extreme pressure agent may vary outside of the ranges above, but is typically both whole and fractional values within these ranges. Further, it is to be appreciated that more than one extreme pressure agent may be included in the lubricant composition, in which case the total amount of all the extreme pressure agent included is within the above ranges.

In regards to the dispersant, any dispersant known in the art may be used. Suitable, non-limiting examples of the one or more dispersant includes polybutenylsuccinic amides or -imides, polybutenylphosphonic acid derivatives and basic magnesium, calcium and barium sulfonates and phenolates, succinate esters and alkylphenol amines (Mannich bases), and combinations thereof.

If included, the dispersant may be present in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, parts by weight based on 100 parts by weight of the lubricant composition. The amount of the dispersant may vary outside of the ranges above, but is typically both whole and fractional values within these ranges. Further, it is to be appreciated that more than one dispersant may be included in the lubricant composition, in which case the total amount of all the dispersant included is within the above ranges.

In regards to the corrosion inhibitor, any corrosion inhibitor known in the art may be used. Suitable non-limiting examples include dimethylethanolamine, 1-amino-2-propanol, octylamine octanoate, condensation products of dodecenyl succinic acid or anhydride and/or a fatty acid such as oleic acid with a polyamine.

If included, the corrosion inhibitor may be present in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, parts by weight based on 100 parts by weight of the lubricant composition. The amount of the corrosion inhibitor may vary outside of the ranges above, but is typically both whole and fractional values within these ranges. Further, it is to be appreciated that more than one corrosion inhibitor may be included in the lubricant composition, in which case the total amount of all the corrosion inhibitor included is within the above ranges.

In regards to the metal deactivator, any metal deactivator known in the art may be used. Suitable non-limiting examples include benzotriazoles and derivatives thereof, for example 4- or 5-alkylbenzotriazoles (e.g. triazole) and derivatives thereof, 4,5,6,7-tetrahydrobenzotriazole and 5,5'-methylenebisbenzotriazole; Mannich bases of benzotriazole or triazole, e.g. 1-[bis(2-ethylhexyl)aminomethyl)triazole and 1-[bis(2-ethylhexyl)aminomethyl)benzotriazole; and alkoxyalkylbenzotriazoles such as 1-(nonyloxymethyl) benzotriazole, 1-(1-butoxyethyl)benzotriazole and 1-(1-cyclohexyloxybutyl)triazole, and combinations thereof.

Additional non-limiting examples of the metal deactivator include 1,2,4-triazoles and derivatives thereof, for example 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl)imidazol-2-yl] carbinol octyl ether, and combinations thereof.

Further non-limiting examples of the metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further non-limiting examples of the one or more metal deactivator includes amino compounds, for example salicylidenepropylenediamine, salicylaminoguanidine and salts thereof, and combinations thereof.

If included, the metal deactivators may be present in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, parts by weight based on 100 parts by weight of the lubricant composition. The amount of the metal deactivators may vary outside of the ranges above, but is typically both whole and fractional values within these ranges. Further, it is to be appreciated that more than one metal deactivator may be included in the lubricant composition, in which case the total amount of all the metal deactivators included is within the above ranges.

In regards to the antifoam agent, any antifoam agent known in the art may be used. Suitable non-limiting examples of the antifoam agent include silicone antifoam agents, acrylate copolymer antifoam agents, and combinations thereof.

If included, the antifoam agent may be present in an amount of from about 1 to about 1000, alternatively from about 1 to about 500, alternatively from about 1 to about 400, ppm based on the total weight of the lubricant composition. The amount of antifoam agent may vary outside of the ranges above, but is typically both whole and fractional values within these ranges. Further, it is to be appreciated that more than one antifoam agent may be included in the lubricant composition, in which case the total amount of all the antifoam agent included is within the above ranges.

In regards to the detergent, any detergent known in the art may be used. Suitable non-limiting examples include overbased or neutral metal sulfonates, phenates and salicylates, and combinations thereof. For example, in various embodiments, the detergent is selected from metal sulfonates, phenates, salicylates, carboxylates, thiophosphonates, and combinations thereof. In one embodiment, the detergent includes an overbased metal sulfonate, such as calcium sulfonate. In another embodiment, the detergent includes an overbased metal salicylate, such as calcium metal salicylate. In yet another embodiment, the detergent includes an alkyl phenate detergent.

If included, the detergent may present in an amount of from about 0.1 to about 5, alternatively of from about 0.1 to about 3, from about 0.1 to about 2, or from about 0.1 to about 1, parts by weight based on 100 parts by weight of the lubricant composition. The amount of detergent may vary outside of the ranges above, but is typically both whole and fractional values within these ranges. Further, it is to be appreciated that more than one detergent may be included in the lubricant composition, in which case the total amount of all the detergent included is within the above ranges.

In regards to the viscosity index improver, any viscosity index improver known in the art may be used. Suitable non-limiting examples include polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If included, the viscosity index improver may be present in the lubricant composition in an amount of from about 0.01 to about 5, from about 0.1 to about 3, or from about 0.1 to about 1, parts by weight based on 100 parts by weight of the lubricant composition. The amount of viscosity index improver may vary outside of the ranges above, but is typically both whole and fractional values within these ranges. Further, it is to be appreciated that more than one viscosity index improver may be included in the lubricant composition, in which case the total amount of all the viscosity index improver included is within the above ranges.

In regards to the antioxidant, any antioxidant known in the art maybe used. Suitable non-limiting examples of the antioxidants include alkylated monophenols, alkylthiomethylphenols, hydroquinones and alkylated hydroquinones, hydroxylated thiodiphenyl ethers, alkylidenebisphenols, O-, N- and S-benzyl compounds, hydroxybenzylated malonates, triazine compounds, aromatic hydroxybenzyl compounds, benzylphosphonates, acylaminophenols, Esters of [3-(3,5-di-tert-butyl-4-hydroxyphenyl)propionic acid with mono- or polyhydric alcohols, esters of β-(5-tert-butyl-4-hydroxy-3-methylphenyl)-propionic acid with mono- or polyhydric alcohols, aminic antioxidants, aliphatic or aromatic phosphites, esters of thiodipropionic acid or of thiodiacetic acid, salts of dithiocarbamic or dithiophosphoric acid, 2 sulfurized fatty esters, sulfurized fats and sulfurized olefins, and combinations thereof, may be used.

If included, the antioxidant may be used in various amounts. The antioxidant is typically present in the lubricant composition in an amount ranging of from about 0.01 to about 5, of from about 0.1 to about 3, or of from about 0.5 to about 2, parts by weight based on 100 parts by weight of the lubricant composition. The amount of the antioxidant may vary outside of the ranges above, but is typically both whole and fractional values within these ranges. Further, it is to be appreciated that more than one antioxidant may be included in the lubricant composition, in which case the total amount of all the antioxidant included is within the above ranges.

In certain embodiments the lubricant composition consists essentially of the biodegradable polyalkylene glycol, the inherently-biodegradable polyalkylene glycol, the non-biodegradable polyalkylene glycol, the low viscosity component, and the additive package. In the context of this disclosure, "consists essentially of" allows for the inclusion of less than 5 parts by weight of a total amount of additional Type I-V base oils (i.e., base oils that are not polyalkylene glycols) based on the total weight of the lubricant composition, provided that the additional base oils do not result in the lubricant composition having a biodegradability as defined in OECD 301B of less than 90 parts by weight based on the 100 parts by weight of the lubricant composition. Moreover, in other embodiments, the lubricant composition consists of the biodegradable polyalkylene glycol, the inherently-biodegradable polyalkylene glycol, the non-biodegradable polyalkylene glycol, the low viscosity component, and the additive package.

In certain embodiments, at least about 90 parts by weight of the lubricant composition (based on 100 parts by weight) meet the biodegradability requirements set forth in OECD 301B. In these embodiments, the remaining portion of the lubricant composition not meeting the biodegradability requirements set forth in OECD 301B is either inherently-biodegradable or non-biodegradable as set forth in OECD 301B with the proviso that not more than about 5 parts by weight of the lubricant composition is non-biodegradable as defined in OECD 301B and the non-biodegradable portion also satisfies the non-bioaccumulative requirements set forth in OECD 107. Notably, these embodiments encompass the embodiments of the lubricant composition containing the low viscosity component and the additive package. As such, in certain embodiments, the low viscosity component and the additive package are biodegradable and/or inherently-biodegradable as set forth in OECD 301B.

In certain embodiments, the lubricant composition is particularly useful as a lubricant for marine or ocean going vessels. Accordingly, the lubricant composition may also be generally referred to as a marine lubricant. In these embodiments, the marine lubricant is minimally toxic as determined by OECD 201 for algae, OECD 202 for crustacean, OECD 203 for fish, and the marine lubricant is not chronically toxic as determined by OECD 210 and 211. As such, in these embodiments, if the marine lubricant is egressed into the environment, it is believed that the egression has no significant environmental impact. Without being bound to any particular theory, it is believed that the combination of the biodegradable polyalkylene glycol, the inherently-biodegradable polyalkylene glycol, the non-biodegradable polyalkylene glycol, and the viscosity/chemical structure of these components produce a lubricant composition that is effective as a lubricant and also is environmentally friendly. As such, for at least these reasons, the lubricant composition is particularly useful as a marine lubricant.

In one embodiment, the lubricant composition is a marine lubricant. In this embodiment, the marine lubricant includes the biodegradable polyalkylene glycol in an amount of at least about 30 parts by weight based on 100 parts by weight of the marine lubricant. The polyalkylene glycol has a kinematic viscosity at 40° C. of from about 15,000 to about 100,000 cSt, when measured in accordance with ASTM D445. In this embodiment, the marine lubricant also includes the inherently-biodegradable polyalkylene glycol in an amount of from about 0.1 to about 10 parts by weight based on 100 parts by weight of the marine lubricant. The inherently-biodegradable polyalkylene glycol has a kinematic viscosity at 40° C. of from about 130 to about 5,000 cSt, when measured in accordance with ASTM D445. In this embodiment, the marine lubricant further includes the non-biodegradable polyalkylene glycol in an amount of from about 0.1 to about 5 parts by weight based on 100 parts by weight of the marine lubricant. The non-biodegradable polyalkylene glycol has a kinematic viscosity at 40° C. of from about 15,000 to about 100,000 cSt, when measured in accordance with ASTM D445. Moreover, the may further include water and diethylene glycol, or a combination thereof in an amount of from about 25 to about 60 parts by weight based on 100 parts by weight of the marine lubricant. Without being held to any particular theory, it is believed that the ratio and respective kinematic viscosities of the polyalkylene glycols produce a marine lubricant that is both effective as a lubricant and also environmentally friendly. For example, the marine lubricant of this embodiment is minimally toxic as determined by OECD 201 for algae, OECD 202 for crustacean, OECD 203 for fish, and the marine lubricant is not chronically toxic as determined by OECD 210 and 211. Although not required, the marine lubricant of this embodiment may also be essentially free of Type I, II, III, and IV base oils.

EXAMPLES

A lubricant composition within the scope of this disclosure is provided in Table 1 as Lubricant Composition 1. Each individual component included in Lubricant Composition 1 is provided in parts by weight based on 100 parts of the lubricant composition.

TABLE 1

| Component | Lubricant Composition 1 |
|---|---|
| DI Water | 35.19 |
| Diethylene Glycol | 11.90 |
| Polyalkylene Glycol 1 | 4.90 |
| Polyalkylene Glycol 2 | 40.00 |

TABLE 1-continued

| Component | Lubricant Composition 1 |
|---|---|
| Polyalkylene Glycol 3 | 5.10 |
| Additive 1 | 1.48 |
| Additive 2 | 1.20 |
| Additive 3 | 0.19 |
| Additive 4 | 0.02 |
| Additive 5 | 0.02 |
| Kinematic Vis (40° C.) | 43.2 |
| pH (25° C.) | 9.42 |
| Reserve Alkalinity | 17.8 |

Polyalkylene glycol 1 is an inherently-biodegradable polyalkylene glycol that satisfies the criterion for inherent biodegradability set forth in OECD 301B. More specifically, polyalkylene glycol 1 is a mixture of copolymers formed from ethylene oxide and propylene oxide (mole ratio of from about 65:35 to about 85:15, respectively) initiated with either diethylene glycol or dipropylene glycol. Moreover, the kinematic viscosity at 40° C. of polyalkylene glycol 1 is about 300 cSt.

Polyalkylene glycol 2 is a biodegradable polyalkylene glycol that satisfies the criterion for biodegradability set forth in OECD 301B. More specifically, polyalkylene glycol 2 is a butanol-initiated copolymer formed from ethylene oxide and propylene oxide (mole ratio of about 49:51, respectively). Moreover, the kinematic viscosity at 40° C. of polyalkylene glycol 2 is about 50 cSt.

Polyalkylene glycol 3 is a non-biodegradable polyalkylene glycol as defined by OECD 301B. However, polyalkylene glycol 3 satisfies the non-bioaccumulative requirements set forth in OECD 107. More specifically, polyalkylene glycol 3 is a trimethylolpropane-initiated copolymer formed from ethylene oxide and propylene oxide (mole ratio of about 75.5:24.5, respectively). Moreover, the kinematic viscosity at 40° C. of polyalkylene glycol 3 is about 66,000 cSt.

Additive 1 is a corrosion inhibitor/anti-wear additive.

Additive 2 is an anti-wear additive.

Additive 3 is a metal deactivator.

Additive 4 is an anti-foam agent.

Additive 5 is a die.

The kinematic viscosity, pH, and reserve alkalinity were measured and are provide in Table 1.

Ecotoxicity of Lubricant Composition 1 was evaluated via OECD 201, 202, and 203. The results of the testing are provided in Table 2.

TABLE 2

| Test | Subject | EC50 | NOEC |
|---|---|---|---|
| OECD 201 | *Pseudokirchneriella subcapitata* (green algae) | 14,000 ppm | 1,750 ppm |
| OECD 202 | *Daphnia magna* (water flea) | 7,400 ppm | 1,250 ppm |
| OECD 203 | *Pimephales promelas* (fathead minnow) | 2,450 ppm | 500 ppm |

The results of the Ecotoxicity testing demonstrate that Lubricant Composition 1 is minimally toxic as determined by OECD 201 for algae, OECD 202 for crustacean, and OECD 203 for fish. The results further indicate that Lubricant Composition 1 has relatively low ecotoxicity, in that the EC50 for all organisms is greater than 100 ppm environmental concentration. Notably, EC50 is the environmental concentration at which half of the organisms are inactivated or killed. While the NOEC is the highest concentration tested with no observable effected. As such, if Lubricant Composition 1 was to egress into the environment, the egression is deemed acceptable by the U.S. EPA Vessel General Permit (VGP) guidelines.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 30, a subrange of from at least 10 to 25, a subrange of from 25 to 30, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims. Moreover, the selection of the solvent(s), amount of solvent(s), the choice of polycarboxylate, and both the choice of alkalinity builder(s) and particle size of the alkalinity builder and other solid raw materials, contained within the Formulations generally manipulates the viscosity of the Formulation.

The present disclosure has been described in an illustrative manner, and it is to be understood that the terminology which has been used is intended to be in the nature of words of description rather than of limitation. Many modifications and variations of the present disclosure are possible in light of the above teachings. The present disclosure may be practiced otherwise than as specifically described. The subject matter of all combinations of independent and dependent claims, both singly and multiply dependent, is herein expressly contemplated.

What is claimed is:

1. A lubricant composition comprising:

a biodegradable polyalkylene glycol satisfying the biodegradability requirements set forth in OECD 301B, wherein said biodegradable polyalkylene glycol is present in an amount of at least about 30 parts by weight based on 100 parts by weight of said lubricant composition;

an inherently-biodegradable polyalkylene glycol satisfying the inherently-biodegradability requirements set forth in OECD 301B, wherein said inherently-biodegradable polyalkylene glycol is present in an amount of from about 0.1 to about 10 parts by weight based on 100 parts by weight of said lubricant composition, wherein said inherently-biodegradable polyalkylene glycol has a kinematic viscosity at 40° C. of from 130 cSt to about 5,000 cSt, when measured in accordance with ASTM D445; and a non-biodegradable polyalkylene glycol as defined by OECD 301B wherein said non-biodegradable polyalkylene glycol satisfies the non-bioaccumulative requirements set forth in OECD 107 and is present in an amount of from about 0.1 to about 5 parts by weight based on 100 parts by weight of said lubricant composition.

2. The lubricant composition as set forth in claim 1 wherein said non-biodegradable polyalkylene glycol comprises a trimethylolpropane initiated copolymer of ethylene oxide and propylene oxide.

3. The lubricant composition as set forth in claim 2 wherein said trimethylolpropane initiated copolymer of ethylene oxide and propylene oxide has a mole ratio of ethylene oxide to propylene oxide of from about 65:35 to about 85:15.

4. The lubricant composition as set forth in claim 1 wherein said inherently-biodegradable polyalkylene glycol comprises a glycol initiated copolymer of ethylene oxide and propylene oxide.

5. The lubricant composition as set forth in claim 4 wherein said glycol initiated copolymer of ethylene oxide and propylene oxide has a mole ratio of ethylene oxide to propylene oxide of from about 65:35 to about 85:15.

6. The lubricant composition as set forth in claim 1 wherein said biodegradable polyalkylene glycol comprises a butanol initiated copolymer of ethylene oxide and propylene oxide.

7. The lubricant composition as set forth in claim 6 wherein said butanol initiated copolymer of ethylene oxide and propylene oxide has a mole ratio of ethylene oxide to propylene oxide of from about 40:60 to about 60:40.

8. The lubricant composition as set forth in claim 1 wherein said non-biodegradable polyalkylene glycol has a kinematic viscosity at 40° C. of from about 15,000 cSt to about 100,000 cSt, when measured in accordance with ASTM D445.

9. The lubricant composition as set forth in claim 1 wherein said biodegradable polyalkylene glycol has a kinematic viscosity at 40° C. of from about 120 cSt to about 30 cSt, when measured in accordance with ASTM D445.

10. The lubricant composition as set forth in claim 1 further comprising a low viscosity component chosen from the group of ethylene glycol, diethylene glycol, propylene glycol, water, or a combination thereof, wherein said low viscosity component is present in an amount of from about 25 to about 60 parts by weight based on 100 parts by weight of said lubricant composition.

11. The lubricant composition as set forth in claim 1 being essentially free of Type I, II, III, and IV base oils.

12. The lubricant composition as set forth in claim 10 comprising said biodegradable polyalkylene glycol, said inherently-biodegradable polyalkylene glycol, said non-biodegradable polyalkylene glycol, and said low viscosity component in a combined amount of from about 85 to about 100 parts by weight based on 100 parts by weight of said lubricant composition.

13. The lubricant composition as set forth in claim 1 further comprising an additive package containing at least one additive chosen from antioxidants, dispersants, corrosion inhibitors, foam control additives, extreme pressure additives, anti-wear additives, detergents, dyes, or a combination thereof.

14. The lubricant composition as set forth in claim 1 wherein said lubricant composition is a marine lubricant.

15. The lubricant composition as set forth in claim 1 wherein said lubricant composition is minimally toxic as determined by OECD 201 for algae, OECD 202 for crustacean, OECD 203 for fish, and said lubricant composition is not chronically toxic as determined by OECD 210 and 211.

16. A lubricant composition comprising:

(i) a first polyalkylene glycol having a kinematic viscosity at 40° C. of from about 30 cSt to about 120 cSt, when measured in accordance with ASTM D445, and wherein said first polyalkylene glycol is present in an amount of at least about 30 parts by weight based on 100 parts by weight of said lubricant composition;

(ii) a second polyalkylene glycol having a kinematic viscosity at 40° C. of from about 130 cSt to about 5,000 cSt, when measured in accordance with ASTM D445, wherein said second polyalkylene glycol is present in an amount of from about 0.1 to about 10 parts by weight based on 100 parts by weight of said lubricant composition; and (iii) a third polyalkylene glycol having a kinematic viscosity at 40° C. of from about 15,000 cSt to about 100,000 cSt, when measured in accordance with ASTM D445, wherein said third polyalkylene glycol is present in an amount of from about 0.1 to about 5 parts by weight based on 100 parts by weight of said lubricant composition.

17. A marine lubricant comprising:

(i) a biodegradable polyalkylene glycol satisfying the biodegradability requirements set forth in OECD 301B, wherein said biodegradable polyalkylene glycol has a kinematic viscosity at 40° C. of from about 30 cSt to about 120 cSt, when measured in accordance with ASTM D445, and wherein said biodegradable polyalkylene glycol is present in an amount of at least about 30 parts by weight based on 100 parts by weight of said marine lubricant;

(ii) an inherently-biodegradable polyalkylene glycol satisfying the inherently-biodegradability requirements set forth in OECD 301B, wherein said inherently-biodegradable polyalkylene glycol has a kinematic viscosity at 40° C. of from about 130 cSt to about 5,000 cSt, when measured in accordance with ASTM D445, and wherein said inherently-biodegradable polyalkylene glycol is present in an amount of from about 0.1 to about 10 parts by weight based on 100 parts by weight of said marine lubricant; and (iii) a non-biodegradable polyalkylene glycol as defined by OECD 301B, wherein said non-biodegradable polyalkylene glycol satisfies the non-bioaccumulative requirements set forth in OECD 107, wherein said non-biodegradable polyalkylene glycol has a kinematic viscosity at 40° C. of from about 15,000 cSt to about 100,000 cSt, when measured in accordance with ASTM D445, and wherein said non-biodegradable polyalkylene glycol is present in an amount of from about 0.1 to about 5 parts by weight based on 100 parts by weight of said marine lubricant;

wherein at least about 90 parts by weight of said marine lubricant based on 100 parts by weight of said marine lubricant meet the biodegradability requirements set forth in OECD 301B, with the remaining portion of said marine lubricant being either inherently-biodegradable or non-biodegradable as set forth in OECD 301B, with the proviso that not more than about 5 parts by weight of said marine lubricant are non-biodegradable as defined in OECD 301B, and said non-biodegradable portion also satisfying the non-bioaccumulative requirements set forth in OECD 107.

18. The marine lubricant as set forth in claim 17 further comprising a low viscosity component chosen from the group of ethylene glycol, diethylene glycol, propylene glycol, water, or a combination thereof, wherein said low viscosity component is present in an amount of from about 25 to about 60 parts by weight based on 100 parts by weight of said marine lubricant.

19. The marine lubricant as set forth in claim 17 wherein said marine lubricant is minimally toxic as determined by OECD 201 for algae, OECD 202 for crustacean, OECD 203 for fish, and said marine lubricant is not chronically toxic as determined by OECD 210 and 211.

* * * * *